United States Patent [19]

Heath

[11] Patent Number: 5,076,726

[45] Date of Patent: Dec. 31, 1991

[54] RECREATIONAL AREA CONSTRUCTION

[76] Inventor: Robert G. Heath, 141 Halstead Ave., Mamaroneck, N.Y. 10543-2619

[21] Appl. No.: 639,889

[22] Filed: Jan. 11, 1991

Related U.S. Application Data

[63] Continuation-in-part of Ser. No. 451,931, Dec. 18, 1989, abandoned, which is a continuation of Ser. No. 403,447, Sep. 6, 1989, abandoned, which is a continuation of Ser. No. 227,817, Aug. 3, 1988, abandoned.

[51] Int. Cl.[5] ..... E02B 11/00

[52] U.S. Cl. ..... 405/38; 405/45; 405/229; 405/46

[58] Field of Search ..... 405/36, 39, 43, 46, 405/50, 229, 38, 37, 45

[56] References Cited

U.S. PATENT DOCUMENTS 3,625,010 12/1971 Hakundy ..... 405/38
3,795,180 3/1974 Larsen ..... 405/36
4,679,963 7/1987 Heath ..... 405/36

FOREIGN PATENT DOCUMENTS 8302790 8/1983 World Int. Prop. O. ..... 405/38

*Primary Examiner*—Dennis L. Taylor
*Assistant Examiner*—J. Russell McBee
*Attorney, Agent, or Firm*—John K. Donaghy

[57] ABSTRACT

A recreational area construction comprising a base having depressions and rises thereon; a plurality of borders forming a perimeter around said base; strips of water pervious material on the base and lining the depressions, and having their ends overlapping whereby water flows laterally across the strips toward the borders; an end of one of said strips extends beneath and beyond said border whereby water is conveyed away from the said area; and a top layer of cushioning material supported on the base and water pervious material.

4 Claims, 6 Drawing Sheets

RECREATIONAL AREA CONSTRUCTION

This application is a continuation-in-part of Ser. No. 07/451,931 (filed Dec. 18, 1989, now abandoned), which is a continuation of Ser. No. 07/403,447 (filed Sept. 6, 1989, now abandoned), which is a continuation of Ser. No. 07/227,817 (filed Aug. 3, 1988, now abandoned).

BACKGROUND OF THE INVENTION:

1. Field of the Invention:

This invention pertains to recreational area structures such as playgrounds and jogging paths which may be seen at schools, municipal grounds, parks and the like.

2. Background of the Prior Art:

The prior art discloses playing surfaces for athletic games which employ, among other things, pile fabric having a moisture-proof backing and other synthetic materials which are placed on the earth, and drainage structures.

Representative of the prior art are patents listed below and copies are furnished for the records.

| Inventor | Patent No. | Title |
|---|---|---|
| S. 6. Summers | 3,083,542 | Device for . . . Drainage Means |
| F. T. Haas, Jr. | 4,044,179 | Playing Surface For . . . Games |
| R. W. Luebke | 4,296,884 | Containment . . . Method |
| M. Curait, Jr. | 4,366,846 | Method for Collecting . . . From . . . Railroad Track Sec. |
| L. Barnett | 4,538,387 | Drainage . . . Subterranean Wall |
| R. G. Heath | 4,679,963 | Playground Construction |
| | Foreign | |
| European Pat. Of. | 85,742 | |
| France | 2,422,772 | |
| Japan | 6,059,230 | |
| United Kingdom | 2,035,098 | |

SUMMARY OF THE INVENTION

Present day children's playground surfaces and jogging paths employ materials such as sand, pea gravel, wood bark and synthetic surfaces made of foam such as polyethylene. Recreational area construction surfaces which are made with these materials have inherent disadvantages and do not provide adequate protection against injury to children due to falls or injury to runner's legs. Moreover, these materials are unsatisfactory in that they do not provide adequate drainage means which will be evident in the numerous puddles which occur after a rain shower.

Therefore, there is a need for a recreational area structure having a surface which provides maximum protection against injury yet provides optimum drainage and is easy and economical to install.

Another object of this invention is to provide a recreational area construction which is aesthetically pleasing to look at yet functions to minimize injury to users thereof.

It is another object of this invention to provide a recreational area construction which has a certain degree of resiliency to cushion the fall of children and greatly reduce injury to joggers.

Yet another object of this invention is to provide a recreational area construction which has an optimum degree of impact attenuation, thus greatly reducing injury due to falls or impact on runner's ankles and knees.

Still another object of this invention is to provide a recreational area construction which utilizes an amalgam of processed wood fiber, selected for size, longevity, fibrous qualities and durability.

Yet another object of this invention is to provide a recreational area construction which provides maximum drainage thus eliminating water puddles and which is dust free and does not harbor living organisms.

These and other objects of the invention will become apparent to those skilled in the art to which the invention pertains from a reading of the following specification when taken in light of the annexed drawings.

Figure 9:
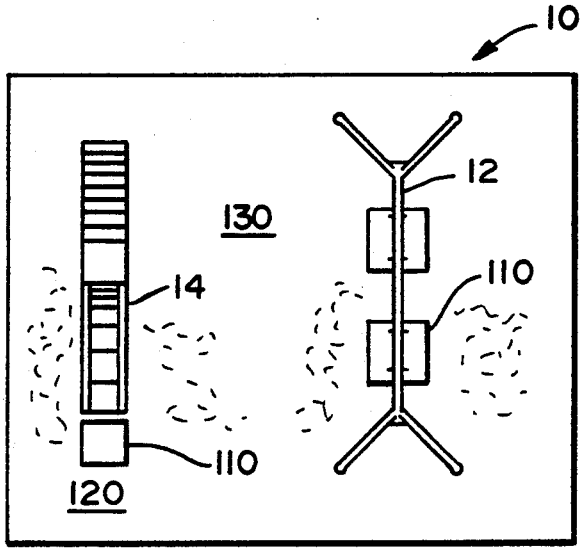
FIG. 9 is a plan view of a recreational area such as a playground showing use of resilient mats located at the bottom of slides, etc.
Figure 10:
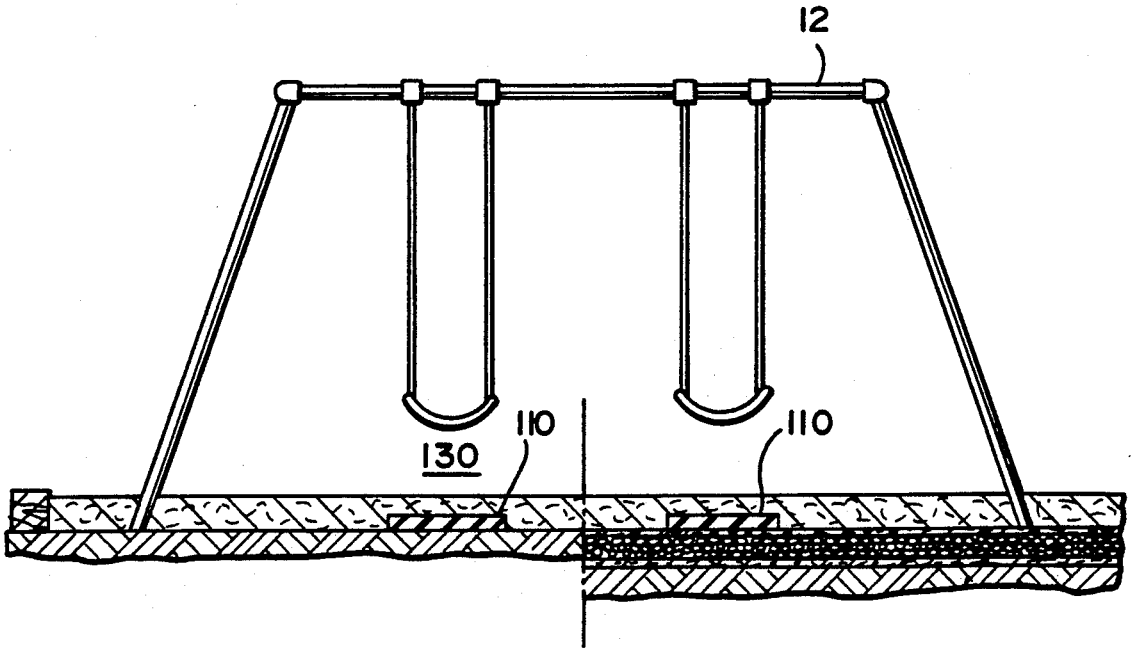
FIG. 10 is a side view of a swing device and a cross-sectional view of the ground which supports the swing.
Figure 5A:
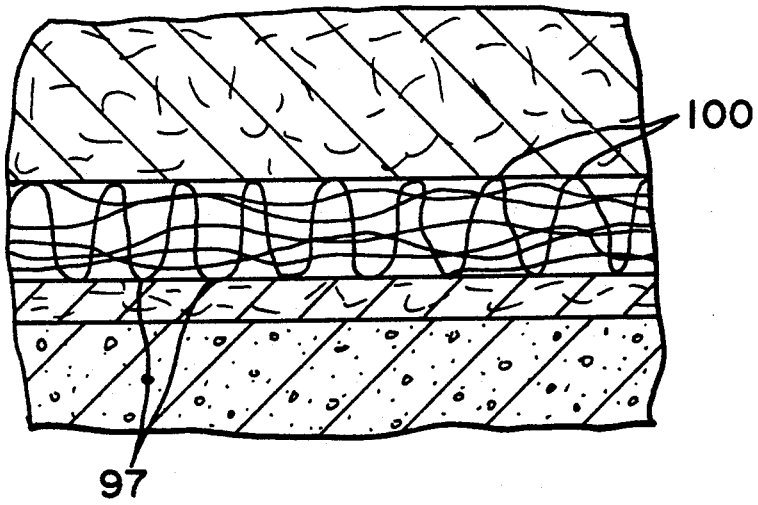
FIG. 5*a* is an enlarged view of the structure shown in FIG. 5.
Figure 8A:
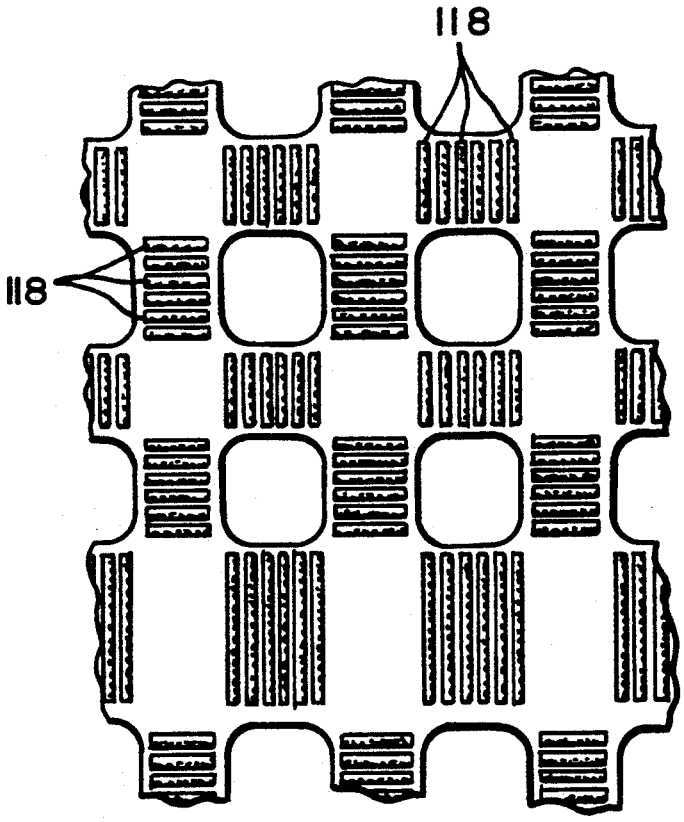
FIG. 8*a* is a reverse view of the structure shown in FIG. 8.

DESCRIPTION OF THE PREFERRED EMBODIMENT OF THE INVENTION:

Referring now in more detail to the drawings, FIG. 9 shows a recreational area 10 having a number of stationary rides 12 and slides 14 as are customarily found in such recreational areas.

Figure 1:
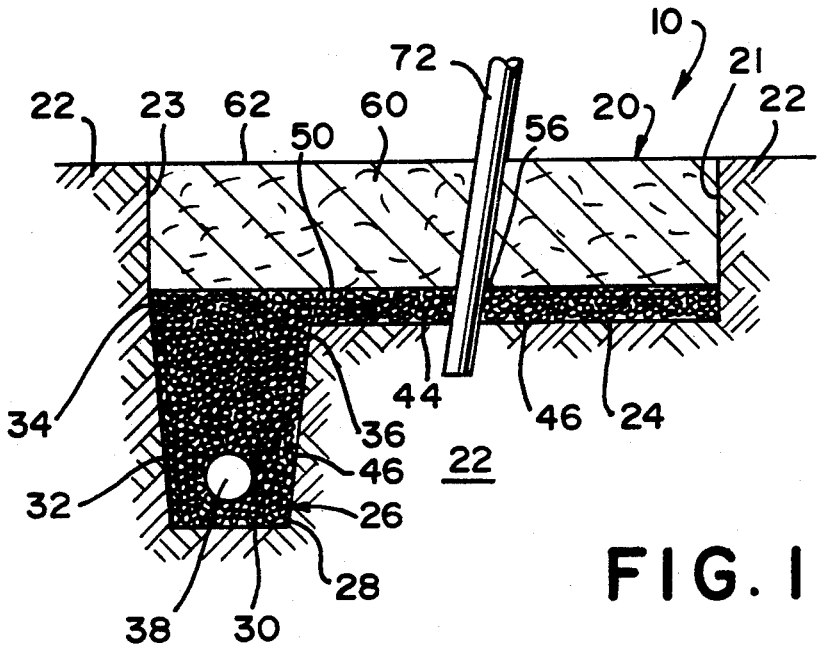
FIG. 1 is a cross-sectional view in section of a recreational area construction showing numerous layers of materials used in the construction thereof.
Figure 2:
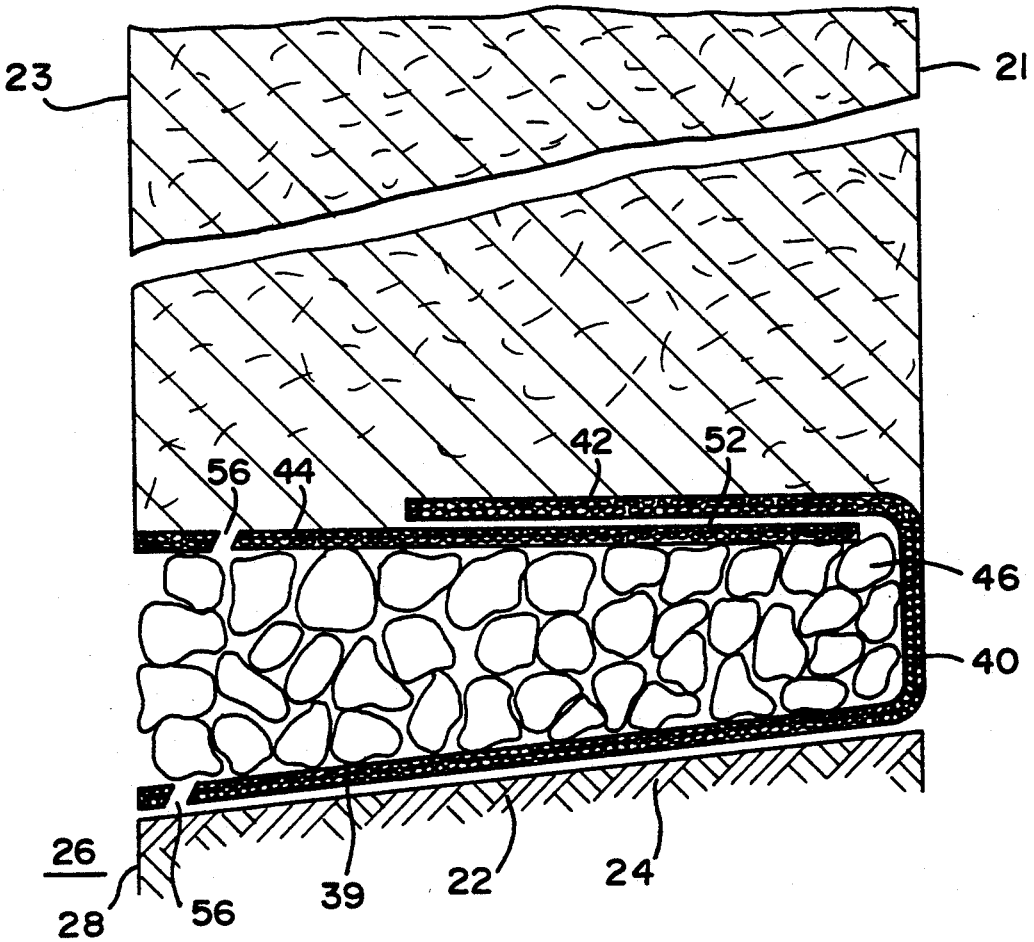
FIG. 2 is a blown-up cross-sectional view as seen in FIG. 1.

FIGS. 1 and 2 show a cross-sectional view of the recreational area 10. An area 20 of approximately 15 inches deep is excavated in the earth 22. The floor 24 is earthen and has a grade of 1 degree to ensure optimum drainage. The area 10 is thus defined by walls 21 and 23 and the sloping earthen floor 24. The area 10 constitutes a recreational area of any desired size.

A trough 26 of about 28 inches deep has a longitudinal extent equal to one of the borders of the recreational area. The trough 26 has a downwardly and inwardly extending wall 28 depending from the floor 24 and terminating at floor 30 which is also earthen. A second wall 32 depends downwardly and inwardly from wall 23 and it also terminates at floor 30. It will be seen that the point 34 of the beginning of the inclination of wall 32 begins at a location above the point 36 of inclination of wall 28. A perforated conduit 38 having a longitudinal extent substantially equal to that of the trough is positioned equidistantly between the walls 28 and 32 and a distance above the floor 30. The distance between the floor 30 and the wall of the conduit 38 at their nearest points is less than the distance between the walls 28 and 32 and the pipe at their nearest points.

A layer of fabric 39 such as that sold under the trademark FIBARFELT has a short section 40 extending upwardly a distance against wall 21 and has a flap section 42 of about 12 inches, the purpose of which will be explained below. The fabric 39 lines floor 24 from wall 21 and descends downwardly along wall 28, across floor 30 and upwardly on wall 32 to point 34. There will be a sufficient quantity of fabric remaining to form a blanket 44 of sufficient length to extend to wall 21, terminating a short distance therefrom.

A layer of one-half to three-quarter inch open aggegate drainage stone 46 fills the trough 26 to point 34. The floor 24 is also covered with stone a height equal to the height of the felt segment 40. It will be apparent that the top layer 50 of stone 46 will be substantially level between the walls 21 and 23.

The top blanket 44 of fabric 39 is drawn across the top layer 50 of the stone 46 and terminates at terminal end 52 adjacent the portion 40. The flap section 42 overlaps the terminal end 52 a minimum of 12 inches. The terminal end 52 and the flap 42 may be fastened together with suitable means such as by "C" clips. Further, the fabric layers 39 and 44 may be provided with slits 56 to be more fully explained below. The fabric may be two pieces instead of one piece.

The space 20 above the fabric blanket 44 and flap section 42 and between the walls 21 and 23 is filled with a layer 60 of wood fiber sold under the trademark FIBAR. The layer 60 of wood fiber is optimally 12 inches deep but may not be less than 6 inches deep. It will be appreciated that the top layer 62 will be loose fiber chips and that the area between the walls 21 and 23 define a recreational area of any size depending on the number of users thereof.

The slits 56 in the fabric 39 and 44 are provided to permit passage of support member 72 for supporting the slides and rides and other devices on the recreational area.

A modified embodiment of the invention is shown in FIGS. 3–8 and 10.

Figure 3:
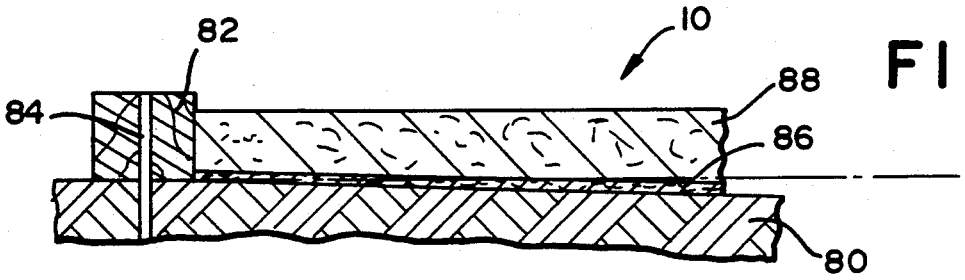
FIG. 3 is a cross-sectional view of a modified form of the invention shown in FIG. 1.

FIG. 3 shows a recreational area 10 whose base 80 may be natural earth, asphalt or concrete having a slop of more than 1 degree to ensure optimum drainage. The borders 82 (one shown) may be landscape timbers, or the like, having anchor means 84 to secure the borders 82 to the base 80. A layer of fabric 86 extends between the borders 82 and rests on the base 80. Supported on the fabric 86 is a top layer 88 of wood fiber sold under the trademark FIBAR. The layer 88 is optimally 12 inches deep, but may not be less than 6 inches deep. This ensures optimum impact attenuation whereby injury due to falls is greatly reduced. The impact attenuation of the wood fiber sold under the trademark FIBAR has been tested and has been found to exceed Consumer Product Safety Commission Guidelines. Twelve inches deep of FIBAR wood fiber provides optimum cushioning whereby the risk of serious head injury due to falls from four-to-ten feet is virtually eliminated.

Figure 4:
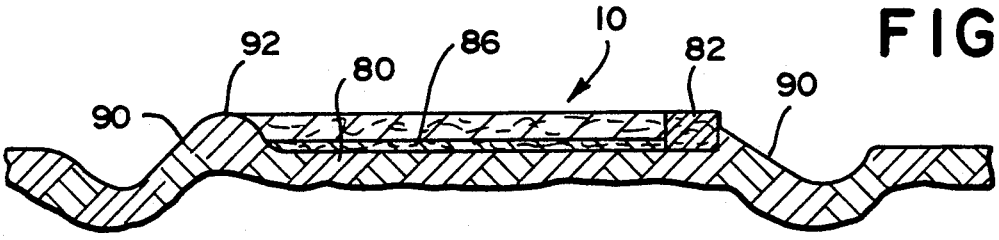
FIG. 4 is a cross-sectional view of yet another modified form of the invention shown in FIG. 3.

FIG. 4 shows a recreational area 10 whose base 80 may be natural earth having uneven terrain 90 on either side thereof. The recreational area 10 is substantially narrower compared to its length which may be hundreds of yards and such might be completed as a jogging path. One border 82 may be landscape timbers or the like. The opposite border may be raised bead of natural earth. Extending between the borders 82 and 92 is a layer of FIBARFELT fabric 86 supported on the base 80. The top layer 88 is wood fiber of between 6 and 12 inches deep.

Figure 5:
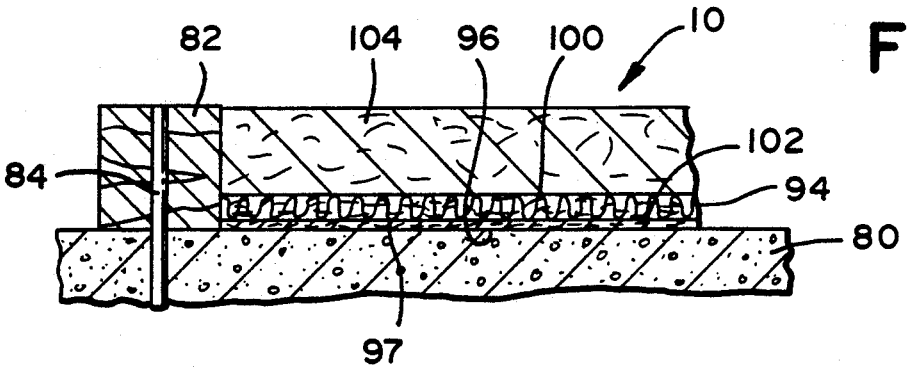
FIG. 5 is a cross-sectional view of another embodiment of the invention shown in FIG. 3.

FIG. 5 is a modified embodiment of the invention shown in FIG. 3. The recreational area 10 has a base 80 of asphalt or concrete. The area 10 has borders 82 (one shown) which may be landscape timbers or the like. Fasteners 84 secure the borders to the base 80. Extending between the border 82 and supported on the base 80 is a layer of resilient open-mesh material 94 whose bottom surface 96 comprises a multiplicity of contact points 97. The layer 94 of resilient open-mesh material has a top surface comprising a multiplicity of contact points 100. A layer of FIBARFELT material 102 is secured to the layer 94 on the multiplicity of contact points 97. Both layers 94 and 102 are pervious to liquid, but are impervious to other solid materials. Supported on the layers 94 and 102 is a top layer of between 6–12 inches of wood fiber 104.

It will be appreciated that the combination of resilient layer and wood fiber layer provides the optimum degree of impact attenuation whereby injury due to falls is substantially reduced, if not eliminated.

Figure 6:
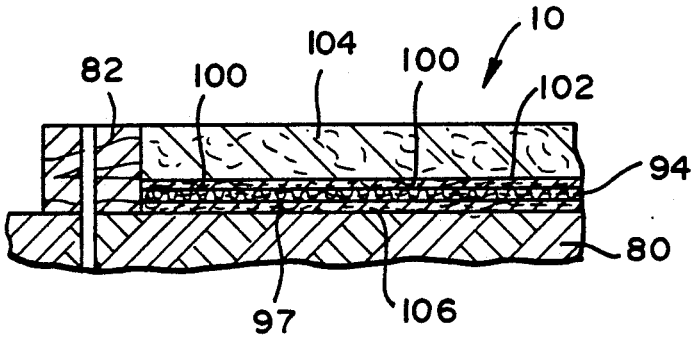
FIG. 6 is a cross-sectional view of yet another embodiment of the invention shown in FIG. 3.

FIG. 6 is a modified form of the structure shown in FIG. 5. The base 80, border 82 as well as top layer 104, are the same. The difference lies in the composition of the lower layers. The lower layers comprise a middle layer of resilient open-mesh material 94 having a multiplicity of contact points 97 on its bottom side and multiplicity of similar contact points 100 on its top side. A first layer of FIBARFELT material 106 is secured by any means, such as adhesive, to the multiplicity of bottom contact points 97 of the resilient open-mesh material 94. A second layer of FIBARFELT material 102 is secured to the multiplicity of top contact points 100 on the open-mesh material 94. This layer of open-mesh material 94 sandwiched between layers of FIBARFELT material 102 and 106 provides a laminate resilient cushion which supports the top layer of wood fiber 104 which is, as in the other constructions, between 6–12 inches deep.

Figure 7:
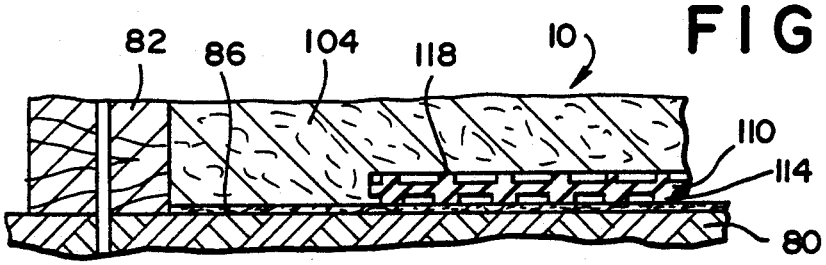
FIG. 7 is similar to FIG. 3 and shows use of a resilient mat beneath the top layer.
Figure 8:
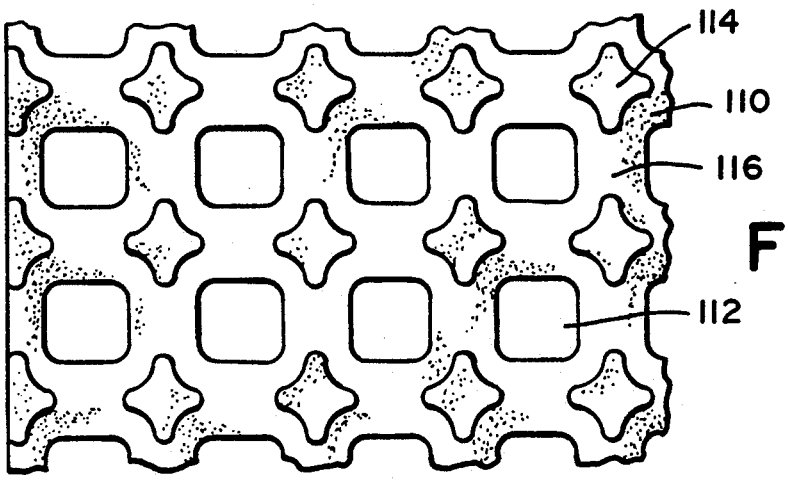
FIG. 8 is a plan view of a section of the resilient mat shown in FIG. 7.

FIG. 7 is similar to FIG. 3 except a rubber mat 110 is used. The mat 110, FIG. 8, has openings 112 throughout its surfaces and multiple contact points 114 on the lower surface 116. The top surface of the mat 110 has a plurality of treads 118 over said surface.

As can be seen, the recreational area 10 comprises a base 80 of any suitable material having borders 82. A layer of FIBARFELT material 86 covers the base 80. The mat 110 covers the FIBARFELT material 86 directly below heavy use areas 120, such as at the end of slides where children contact the ground or below swing area 130, FIGS. 9 and 10. A top layer 104 of between 6–12 inches of wood fiber is shown.

Figure 11:
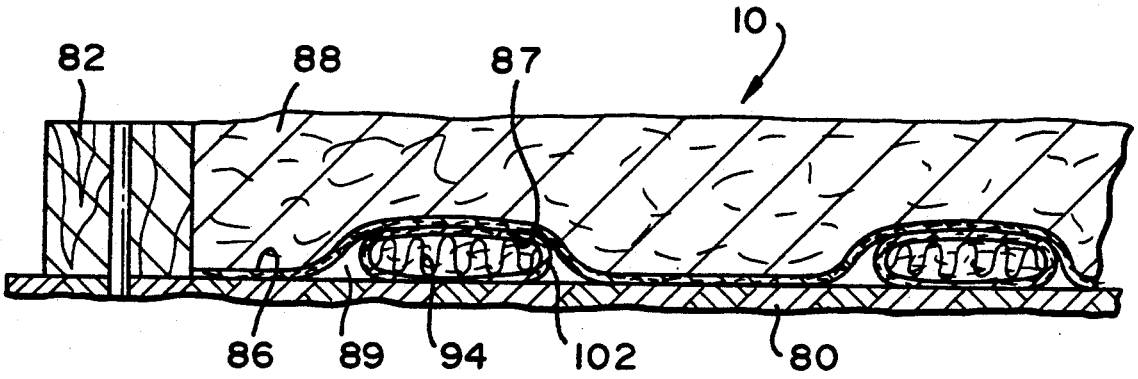
FIG. 11 is a side view of the invention showing strips of drainage material.
Figure 12:
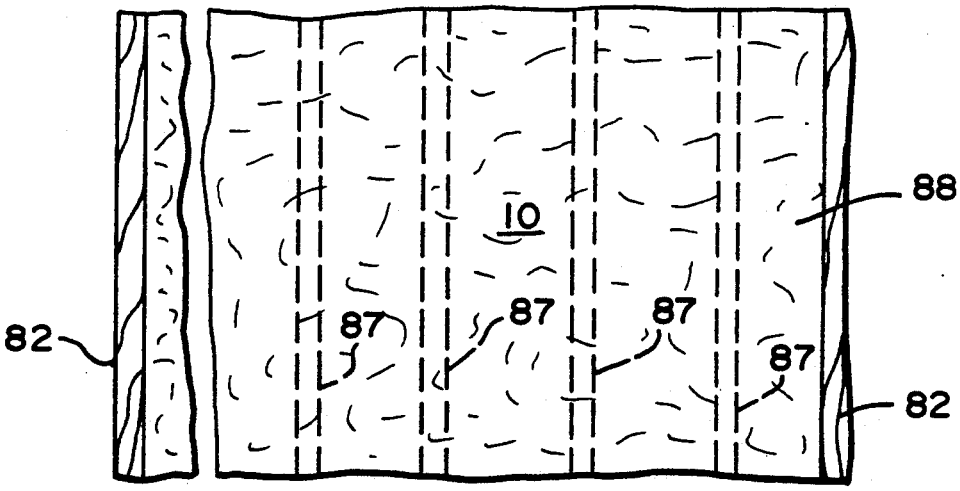
FIG. 12 is a plan view of the invention shown in FIG. 11.

FIG. 11 shows yet another embodiment of the invention wherein border 82 (one shown) encompasses at least two sides of the recreational area 10 having a base 80. Supported on the base 80 at spaced-apart intervals are a plurality of strips 87 of drainage material. The strips 87 extend longitudinally of the length of the recreational area 10 as seen in FIG. 12. Strips 87 are composed of open-mesh resilient material 94 wrapped in FIBARFELT material 102. The strips 87 are somewhat oval in geometry and form longitudinally extending trenches 89 which function, together with the strips 87, as drainage fields for the recreational area 10. Covering the base 80, strips 87 and trenches 89 is a layer of FIBARFELT water pervious material 86 and a top layer 88 of wood fiber material.

Figure 13:
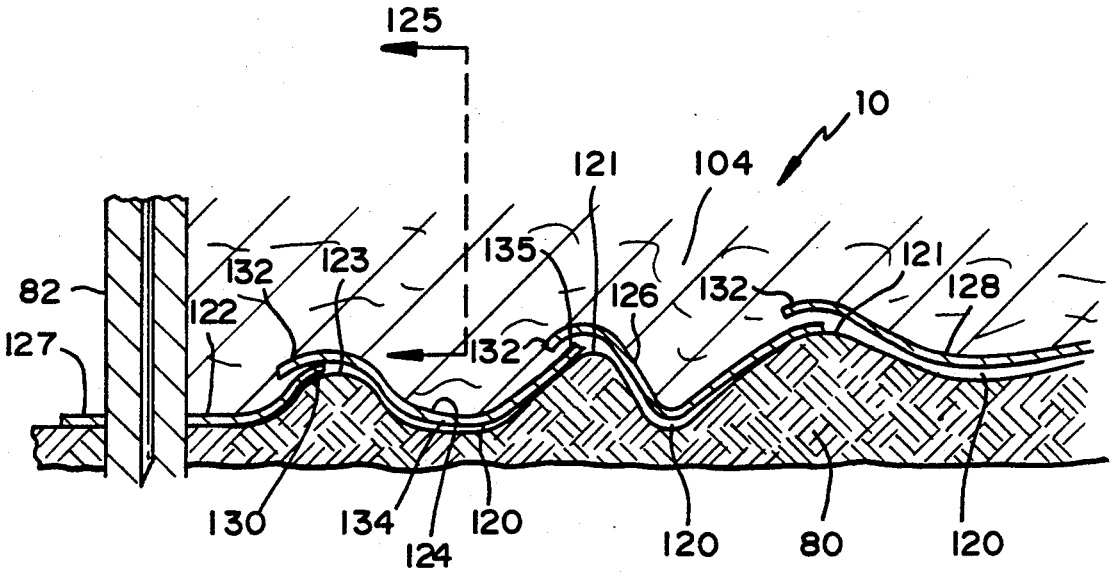
FIG. 13 is a cross-sectional view of a modification of the structure of FIG. 3.
Figure 14:
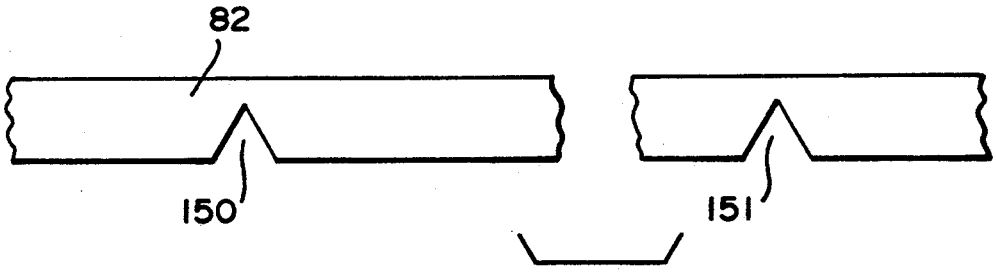
FIG. 14 is an end view of the structure shown in FIG. 13.

FIGS. 13 and 14 show yet another embodiment of the playground 10 with border 82 secured by a stake to the base 80. It will be seen that the base 80 has a multiple series of depressions 120 and rises 121 which occur as a result of natural processes over a period of time. The base 80 in this invention may be asphalt, cement and/or dirt or the like.

Water collects in these depressions or ruts and is absorbed by any material lying thereon such as the FIBARFELT material used in this invention. Such material will begin to deteriorate after long exposure to said standing water puddles.

In order to eliminate these deleterious effects, a new and novel drainage method is used. Fabric-like strips 122–128 of water pervious materials having wicking characteristics are laid over the base. The wicking effect of this material absorbs the water puddles in the depression and conveys the water laterally internally across the various strips.

This lateral flow drains the water in the direction of the arrow 125 internally of the layers or strips 122, 124, 126 and 128 of water pervious materials which are laid over the base 80 as shown. The end strip 122, which is at the lower end of the area 10, has an end 127 extending beneath and beyond the border 82 where the water drains away from the area 10. The other end 130 of each strip extends up the rise 121 to a point near the apex 123 as shown. The next strip 124 has its end 132 overlapping end 130 with its mid-section 134 in depression 120. The other end 135 extends up the rise 121 as shown. Similarly, the strips of 126 and 128 have their ends overlapping each other as shown. The strips may be in specific widths of from 6 inches to 2 or 3 feet, or one size to cover the entire area 10 may be used. The thickness of the strips will be such as to achieve optimum absorption and lateral flow.

By this structure, water which is collected in puddles in depressions 120 may wick up into the strip materials and run off laterally over the ends 132 toward and beneath the borders 82. The borders 82 may have weep holes 150 and 151 so as to aid water run off away from the surface area 10.

The strips or layers 122, 124, 126 and 128 are FIBARFELT material which are water pervious and will allow water to flow downwardly onto the base as well as laterally across the strip toward the border 82. The fabric of this FIBARFELT is of a nature that it will permit water to flow upwardly under hydrostatic pressure, but will prevent contaminants from passing upwardly through the material into the upper layer 104 of wood fiber cushioning material.

While the invention has been described in particular detail with respect to a preferred embodiment thereof, it will be understood to those skilled in the art to which the invention pertains that numerous changes may be made in the invention without departing from the spirit and scope thereof.

What I claim is:

1. A recreational area construction comprising:

a base having depressions and rises thereon wherein water collects;

a plurality of borders forming a perimeter around said base;

strips of water pervious material having wicking characteristics on the base and lining the depressions, and having their ends overlapping whereby said water is absorbed in said strips and flows laterally internally across the strips toward the borders;

an end of one of said strips extends beneath and beyond said border whereby water is conveyed away from the said area; and a top layer of cushioning material supported on the base and water pervious material.

2. A recreational area construction according to claim 1, wherein:

at least one of said borders has weep-holes for egress of said water.

3. A recreational area construction according to claim 1, wherein:

said strips have wicking characteristics whereby water is absorbed therein and is conveyed internally thereof to the outside of the area.

4. A recreational area construction according to claim 1, wherein:

said strips may be a single strip covering the entirety of said area.

* * * * *

UNITED STATES PATENT AND TRADEMARK OFFICE

CERTIFICATE OF CORRECTION

PATENT NO. : 5,076,726

DATED : December 31, 1991

INVENTOR(S) : Robert G. Heath

It is certified that error appears in the above-identified patent and that said Letters Patent is hereby corrected as shown below:

On the title page, in item [63], after "Dec. 18, 1989," delete "abandoned" and insert -- Pat. No. 5,026,207--; and Column 1, line 5, after "Dec. 18, 1989," delete "now abandoned", insert -- now Pat. No. 5,026,207, issued June 25, 1991 --.

Signed and Sealed this

Eighteenth Day of May, 1993

*Attest:*

Michael K. Kirk

MICHAEL K. KIRK

*Attesting Officer*

*Acting Commissioner of Patents and Trademarks*